United States Patent [19]

Lichterman

[11] 4,050,693

[45] Sept. 27, 1977

[54] PUNCHING BAG AND SUPPORT MEANS FOR SUPPORTING SAME IN A DOOR FRAME AND THE LIKE TO PREVENT TWISTING OR TURNING OF THE SUPPORT MEANS

[75] Inventor: Noah Lichterman, Chicago, Ill.

[73] Assignee: Martin Yale Industries, Inc., Chicago, Ill.

[21] Appl. No.: 669,097

[22] Filed: Mar. 22, 1976

[51] Int. Cl.[2] ..... A63B 69/22

[52] U.S. Cl. ..... 272/78; 272/62

[58] Field of Search ..... 272/78, 77, 76, 900, 272/61, 62, 63, 109, 112

[56] References Cited

U.S. PATENT DOCUMENTS

| | | | |
|---|---|---|---|
| 802,312 | 10/1905 | Pierro | 272/62 |
| 1,978,499 | 10/1934 | Loveridge | 272/78 |
| 2,594,605 | 4/1952 | Zoppelt | 272/62 UX |
| 3,716,232 | 2/1973 | Johnson et al. | 272/63 |
| 3,813,095 | 5/1974 | Long | 272/78 |

FOREIGN PATENT DOCUMENTS

| | | | |
|---|---|---|---|
| 350,864 | 3/1922 | Germany | 272/63 |
| 6,600,417 | 7/1967 | Netherlands | 272/62 |
| 318,719 | 9/1929 | United Kingdom | 272/78 |
| 1,229,382 | 4/1971 | United Kingdom | 272/78 |

*Primary Examiner*—Richard C. Pinkham
*Assistant Examiner*—Arnold W. Kramer
*Attorney, Agent, or Firm*—Vogel, Dithmar, Stotlant, Stratman & Levy

[57] ABSTRACT

This invention relates to a combination comprising a punching bag and the means for supporting same which includes an adjustable horizontal support member supported between the vertical jambs of a door frame and the means for supporting the punching bag thereon and also includes another member secured at one end to the horizontal support member and provided at its other end with clamping means which are secured to the opposite ends of the door jamb to prevent the horizontal support member from twisting or turning due to the vibrations and movements of the punching bag during the punching action. The clamping means, which are secured to the vertical door jamb, are adjustable to accommodate door jambs of different widths.

7 Claims, 5 Drawing Figures

PUNCHING BAG AND SUPPORT MEANS FOR SUPPORTING SAME IN A DOOR FRAME AND THE LIKE TO PREVENT TWISTING OR TURNING OF THE SUPPORT MEANS

BRIEF SUMMARY OF THE INVENTION

In supporting a punching bag in a doorway between the vertical jambs, the means for supporting same must be such that they are detachable from the door jamb, so that the unit may be readily mounted and demounted from the door frame. When such units are positioned between the opposite vertical door jambs, it has been found that the vibration and movement of the punching bag due to the punching action will cause the horizontal support means to twist or turn due to the back and forth movement and vibration of the punching bag and this tends to loosen the horizontal support between the door jambs. With this invention this is obviated as there is provided an arm secured to the horizontal support and clamping means which are secured to the arm, which clamping means, in turn, are secured to the opposite ends of the door jamb which will prevent the twisting or turning of the horizontal support.

Another object of this invention is to provide a clamping means of the foregoing character which are adjustable to accommodate different widths or thicknesses of door jambs.

Another object of this invention is to provide a horizontal support which has an initial adjustment and a finer adjustment to accommodate door openings of different widths.

DESCRIPTION OF THE PREFERRED EMBODIMENT

Figures 1, 5:
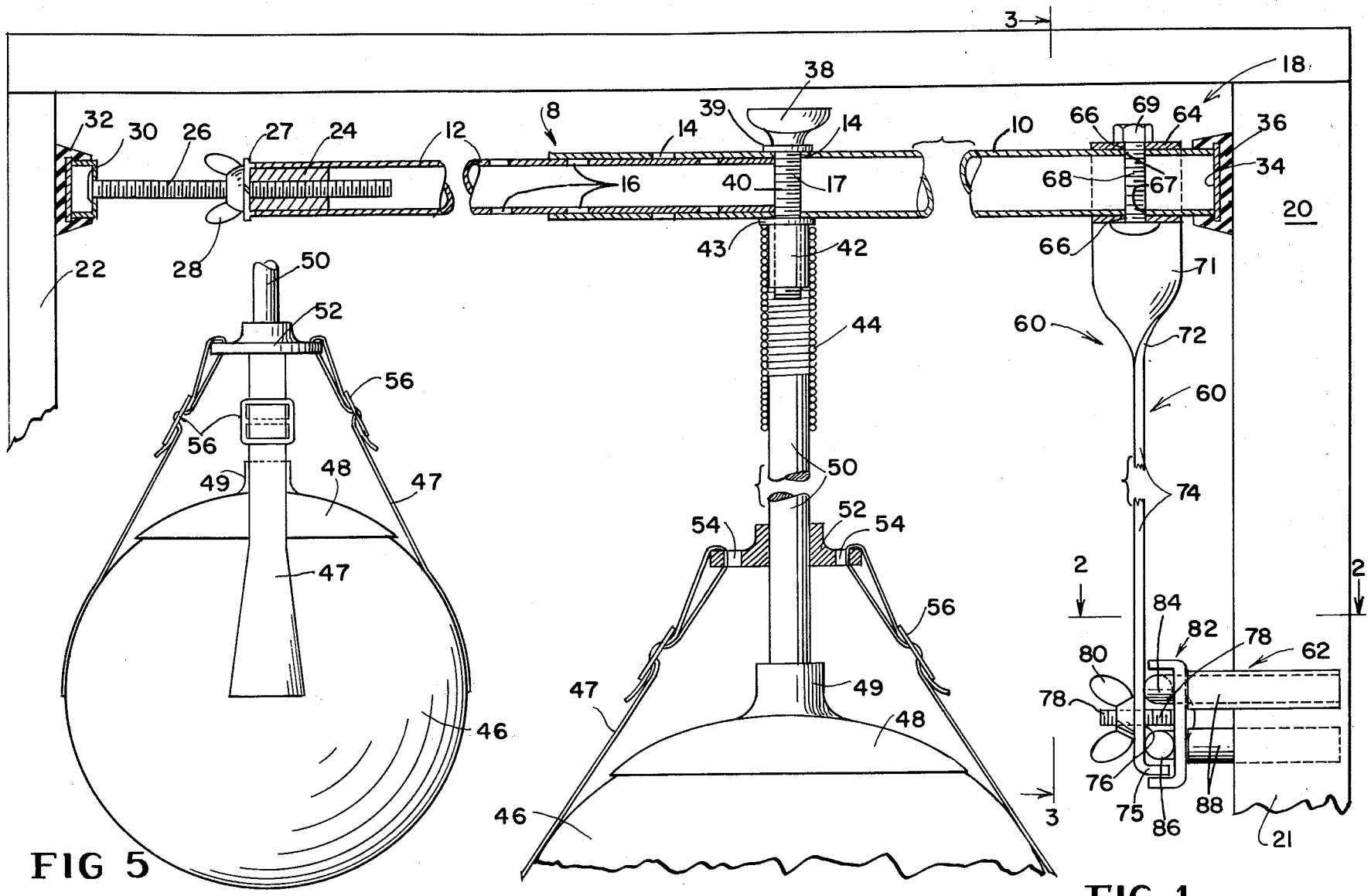
FIG. 1 is a view partly in cross section showing the invention supported in a doorway between the vertical jambs of the doorway.
FIG. 5 is a fragmentary view showing the punching bag and the manner it is secured to the vertical rod.

The cross member or horizontally positioned support member for supporting the punching bag is generally indicated at 8 and includes a first tubular member generally indicated at 10 and a second tubular member generally indicated at 12 which is of a smaller diamater and telescopically fits within the first tubular member 10 and is adjustable longitudinally relative thereto. Both of said tubular members are made preferably of metal. The first tubular member 10 has a plurality of spaced aligned openings generally indicated at 14 and the second tubular member has a plurality of spaced aligned openings generally indicated at 16 which are adapted to be aligned with the openings 14 for the longitudinal adjustment of the two tubular members. The two tubular members 10 and 12 are locked in their adjusted position by means of a threaded bolt or threaded stud generally indicated at 17 which is passed through the aligned openings and which bolt or stud 17 is made preferably of metal and also serves as the anchoring means for supporting the punching bag as will be more fully described hereafter. The two tubular members 10 and 12 are initially adjusted relative to each other with respect to the width of the door frame generally indicated at 18 by inserting the bolt or stud 17 through the aligned openings in the tubular members 10 and 12. The two spaced door jambs of the door frame are indicated by the numerals 20 and 22. The finer adjustment of the horizontally positioned support member 8 will be subsequently described.

The free end of the second tubular member 12 supports a plug 24 which is internally threaded and is adapted to threadedly receive an externally threaded metal stem 26. A washer 27 and a wing nut 28 are secured on said threaded stem with the washer bearing against the free end of the second tubular member 12. The wing nut 28 permits adjustment of the threaded stem 26 relative to the second tubular member and also when once adjusted, permits locking of the threaded stem in the adjusted position. The outer end of the threaded stem 26 fixedly supports an annular member 30 which is in threaded engagement with the stem 26 so that it is likewise adjustable on the threaded stem 26. The annular member 30 supports a rubber gasket or rubber cap 32 which is adapted to engage the surface of the vertical door jamb 22 of the door frame 18. The free end of the first tubular member 10 is closed by an annular plate 34 on which is mounted an annular rubber gasket or rubber cup 36 which is adapted to engage the other vertical door jamb 20.

The threaded bolt or stud 17 has a head 38 and is supported by a washer 39 with the threaded portion 40 of the bolt passing through the two aligned openings 14 in tubular member 10 and extending downwardly thereof. As shown in FIG. 1, the inner end of tubular member 12 in this instance abuts against the bolt 17; however, in instances where the width of the door frame is less than that shown, the tubular member 12 would telescope further into the tubular member 10 and the bolt 17 would extend through the pairs of aligned openings 14 and 16 in the two tubular members.

Secured to the lower end of the threaded member 17 is an internally threaded sleeve 42 having a flange 43 at the upper end thereof. Mounted on the sleeve 42 is a coil or compression spring generally indicated at 44 which extends downwardly thereof. The punching bag generally indicated at 46 is of conventional construction and said punching bag has a plurality of flexible straps 47 secured to it well known in the art. The punching bag fits against a dome-shaped member 48. The dome-shaped member 48 has an upstanding portion 49 having a well portion which fixedly receives the lower end of a tubular member or rod 50 made preferably of metal with the upper end of the tubular member 50 being secured to the lower end of the spring or compression member 44. A collar 52 is fixedly supported on the tubular member 50 and said collar has a plurality of spaced openings 54 to which the straps 47 of the punching bag are secured. The straps 47 are adjustable and are secured by buckles 56.

Figure 3:
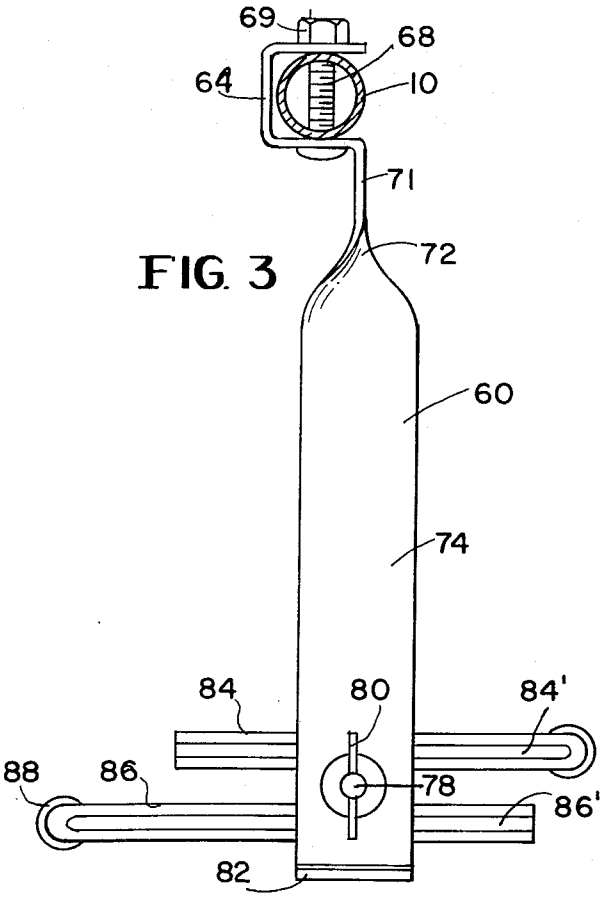
FIG. 3 is a view taken on lines 3—3 of FIG. 1.
Figure 4:
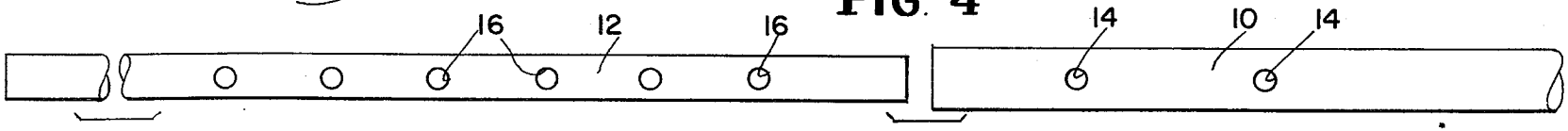
FIG. 4 is a plan view of the two tubular members separated and forming part of the horizontal support means.

To prevent the horizontally positioned support member 8 from turning or twisting as the punching bag is punched, and thereby vibrate or move back and forth due to the spring 44, there is provided an arm generally indicated at 60 and clamping means generally indicated at 62. The upper end of the arm 60 is secured to the first tubular member 10 with the clamping means 62 adjacent the bottom of the arm secured to the opposite ends 21 of the vertical door jamb 20. The arm 60, which is best shown in FIGS. 1 and 3, is preferably a flat strip of steel, the upper end of which is generally of U-shaped configuration in cross section indicated at 64, which end is adapted to engage the first tubular member 10. The tubular member is provided with a pair of vertically aligned openings 66 adjacent the outer end of said tubular member. The sides of the U-shaped portion 64 of the arm 60 has aligned openings 67 which are aligned with the openings 66 to receive a threaded bolt 68 secured by a nut 69 to anchor the arm 60 to the tubular member 10 in a fixed position and thereby support the arm suspended downwardly from the horizontal tubular member 8. The arm extends downwardly as at 71 of the U-shaped portion and then is twisted or turned as at 72 so that the plane of the major portion 74 of the arm is at right angles to the portion 71 with the portion 74 parallel to the adjacent door jamb 20. The lower end of the arm is bent outwardly to provide a bottom flange portion 75. The arm 60 is also provided with an opening 76 adjacent the lower end to receive the threaded bolt 78 and secured thereto by a wing nut 80. The threaded bolt 78 supports a U-shaped metal plate 82 with the plate 82 having an opening through which the bolt 76 extends with the head of the bolt engaging the vertical wall of said U-shaped plate. As best seen in FIG. 1, the lower end of the U-shaped plate 82 extends below the flange 75 of the arm 60 with the upper end of the plate 82 extending upwardly thereof.

Figure 2:
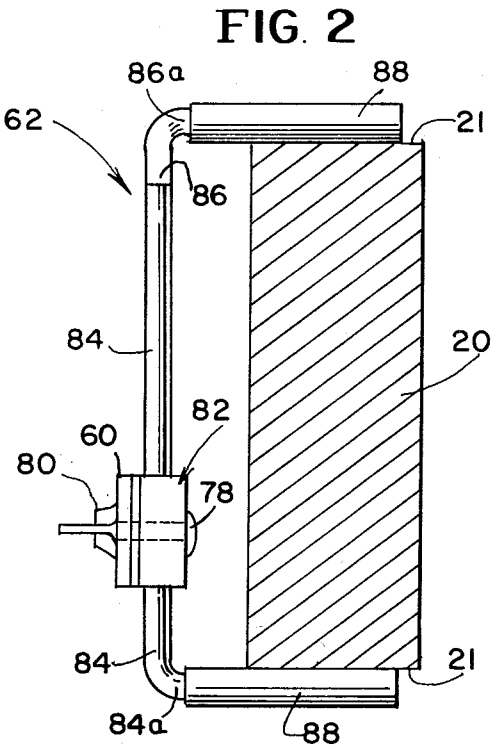
FIG. 2 is a top plan view taken on lines 2—2 of FIG. 1 showing the clamping means which serves to prevent or limit the twisting and turning of the horizontal support member.

A pair of L-shaped metal clamping bars or rods 84 and 86 are adjustably supported between the arm 60 and the plate 82 and said L-shaped bars or rods are positioned one above the other with the longitudinal portions of each of said bars or rods fitting between the plate 82 and the arm 60 and held therebetween. The bars or rods 84 and 86 are each round in cross section except for the surface 84' and 86' which are flat or planar so that they rest against the flat plane of the arm 60. The outwardly turned ends **84*a* and 86*a* respectively of each of the clamping rods 84 and 86 are each adapted to engage the opposite ends 21 of the same door jamb 20 as best shown in FIG. 2. Each of the ends of the rods is provided with a rubber sleeve 88 so that when it engages the ends 21 of the door jamb, it will not mar the surface thereof. The clamping bars 84 and 86 are adjustable relative to each other to accommodate door jambs of different thicknesses or widths and are locked in position by tightening the wing nut 80 which brings the plate 82 into tight engagement with the longitudinal portions of the clamping bars 84 and 86 and holds them tight against the surface of the arm 60** to lock same in their adjusted position.

The said clamping means 82 and the suspended arm 60, which is locked in clamping position relative to the door jamb, serves to prevent the horizontal support 8 from twisting or turning when the punching bag is punched. Without the aforesaid clamping means and arm, the horizontal support 8 would tend to twist and loosen between the door jambs as the punching bag vibrates or moves back and forth due to the punching action. This objectionable characteristic is eliminated with this invention.

I claim:

1. In combination, a punching bag and means for supporting same in a door frame having spaced apart vertical door jambs, said support means including a horizontally positioned and longitudinally adjustable means positioned between and supported by the door jambs, a punching bag supported on said support means, a rigid arm secured to said support means extending downwardly therefrom parallel to the adjacent door jamb, clamping means secured to said rigid arm substantially away from said support means and adapted to engage the opposite ends of the adjacent door jamb to prevent said support means from twisting or turning as said punching bag moves or vibrates back and forth, said clamping means being adjustable to adapt to door jambs of different dimensions between said opposite ends.

2. The combination set forth in claim 1, in which only a single rigid arm extends downwardly from said support means and in which said adjustable clamping means on said rigid arm is on substantially the same horizontal plane as the top of said punching bag.

3. A combination as set forth in claim 1 in which the adjustable clamping means comprises a pair of generally L-shaped members adjustable relative to each other and held in locked position with respect to the arm.

4. A combination as set forth in claim 3, in which the longitudinal portion of each of said L-shaped members is positioned against the arm and locked in an adjustable position by means of a plate held by a fastening member secured to the lower end of the arm.

5. A combination as set forth in 1, in which the horizontally positioned support means includes a plurality of tubular members telescopically arranged and adjustable relative to each other for an initial adjustment between the door jamb with the rigid arm secured to one of said tubular members and extending downwardly thereof with the adjustable clamping means secured to the bottom of the arm and in which one of said tubular members supports an adjustable member for a second and final adjustment.

6. A combination as set forth in claim 5 in which the punching bag is supported on said tubular members by means of a threaded stud and a coiled spring with the lower end of the spring attached to a rod which supports a dome-shaped member with a portion of the punching bag positioned within the dome-shaped member and with straps attached to said punching bag and to said rod.

7. A combination as set forth in claim 6, in which the adjustable clamping means attached to the arm comprise a pair of L-shaped members which are adjustable relative to each other.

* * * * *